United States Patent [19]

Sykes

[11] Patent Number: 4,589,571

[45] Date of Patent: May 20, 1986

[54] VENDING MACHINE DISPENSING DEVICE

[76] Inventor: Willard D. Sykes, 5613-152nd St. N., Hugo, Minn. 55038

[21] Appl. No.: 633,401

[22] Filed: Jul. 23, 1984

[51] Int. Cl.[4] ..... G07F 11/24

[52] U.S. Cl. ..... 221/75

[58] Field of Search ..... 414/129, 131; 221/75, 221/277, 231; 222/412, 413

[56] References Cited

U.S. PATENT DOCUMENTS

| | | | |
|---|---|---|---|
| 1,103,919 | 7/1914 | Tarasch | 221/231 |
| 3,387,743 | 6/1968 | Algino | 221/75 |
| 4,084,725 | 4/1978 | Buchser | 221/75 |

FOREIGN PATENT DOCUMENTS

| | | | |
|---|---|---|---|
| 1175668 | 12/1969 | United Kingdom | 221/231 |

*Primary Examiner*—Stanley H. Tollberg
*Attorney, Agent, or Firm*—Leo Gregory

[57] ABSTRACT

A product dispensing mechanism in a vending machine dispensing such products as cigarettes and candy bars, the mechanism permitting the product to be vertically stacked in the vending machine, the lowermost unit of the product being seated between the adjacent coils of a short length of a coiled member which is rotated by an external operating member to advance the product along the member and discharge the same down a dispensing ramp.

3 Claims, 5 Drawing Figures

17a
30
70
70d
17c
41a
17b
15
29
23
27
21
18
70c
41
30
70b
72
25
12a
67
19
19a
26
5
5
3
3

17
14
17a
45
47
56
50
47a
37
17b
33
40
70a
41
39
38
35
30
46
55
46a
13
36
32

VENDING MACHINE DISPENSING DEVICE

BACKGROUND OF THE INVENTION

1. Field Of Invention

This invention relates to a mechanism for dispensing goods from a vending machine.

2. Brief Description of the Prior Art

Goods are customarily carried in vending machines in horizontally disposed rows and are commonly loaded onto a coil spring acting as a screw conveyor in advancing the product carried thereon in the direction of the dispensing chute.

The above practice results in requiring housings to have considerable depth and to require considerable floor space and a length of a coil spring sufficient to have the supply of product in the machine loaded into the coils thereof.

It is desirable to have means for dispensing a product from a vending machine which would permit a product to be stacked vertically to permit the use of housings of fairly narrow depth which would require relatively small areas of floor space.

SUMMARY OF THE INVENTION

This invention relates to an improvement in the means used in a vending machine for dispensing products, such as cigarettes, candy bars and the like.

It is desirable to have such means as will permit a maximum amount of space for holding the supply of goods in such a manner as will permit a machine design to require a minimum amount of space for installation. In prior art machines, the goods are carried in a machine in horizontal rows from front to back. This arrangement requires a machine housing to have substantial depth and corresponding floor space.

The invention herein permits the vertical stacking of a product which requires a fairly tall housing but one of a very small depth and such a housing could readily be wall mounted and require very limited floor space.

More specifically, it is an object of this invention to provide a mechanism at the base of a vertical stack of a product to move the bottom most unit of the product to be dispensed down a dispensing chute and the stack of product drops downwardly as each item is thus dispensed.

Further, it is an object of this invention to provide at the base of a stack of product in a vending machine a coil member of short length having a pitch such that the space between adjacent coils is sufficient to receive a unit of the product and that the rotation of the coil will advance said unit of product to be disposed down a dispensing chute. The equivalent on the order of two coils are practically all that are required for the purpose indicated and thus there may be very little depth in the housing of the vending machine.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
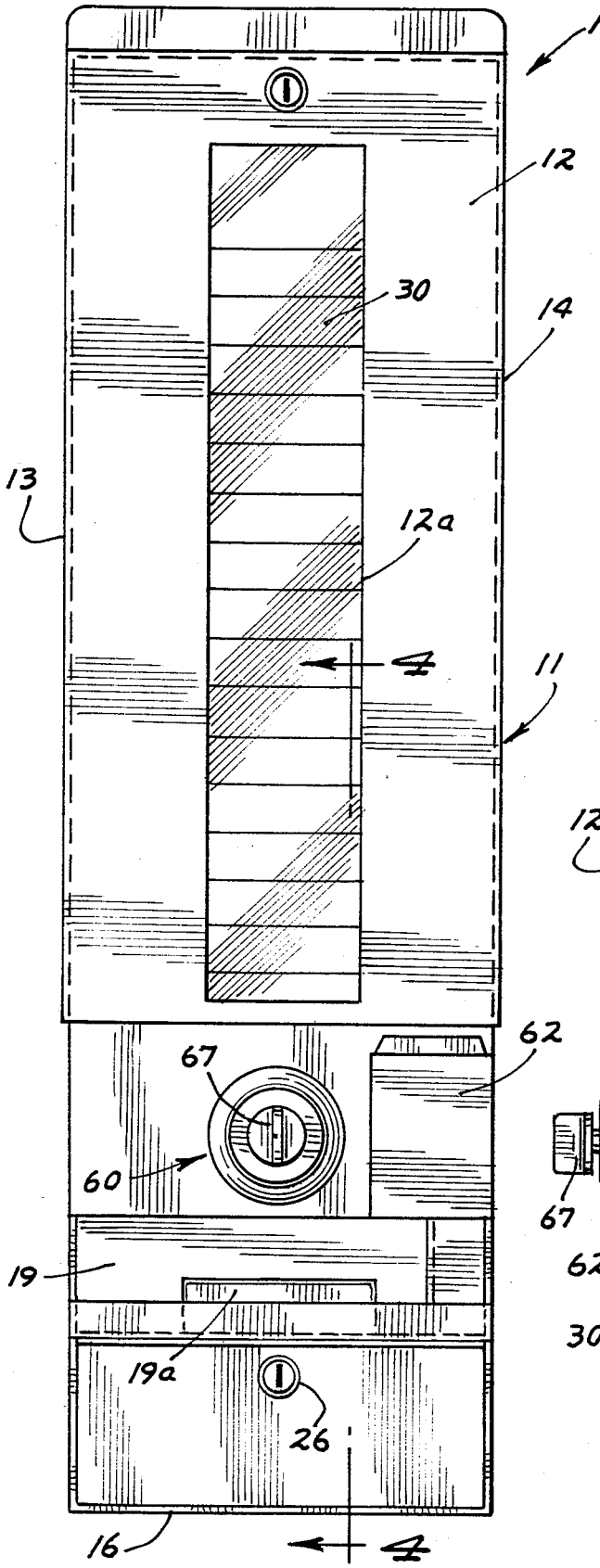
FIG. 1 is a view in front elevation.
Figure 2:
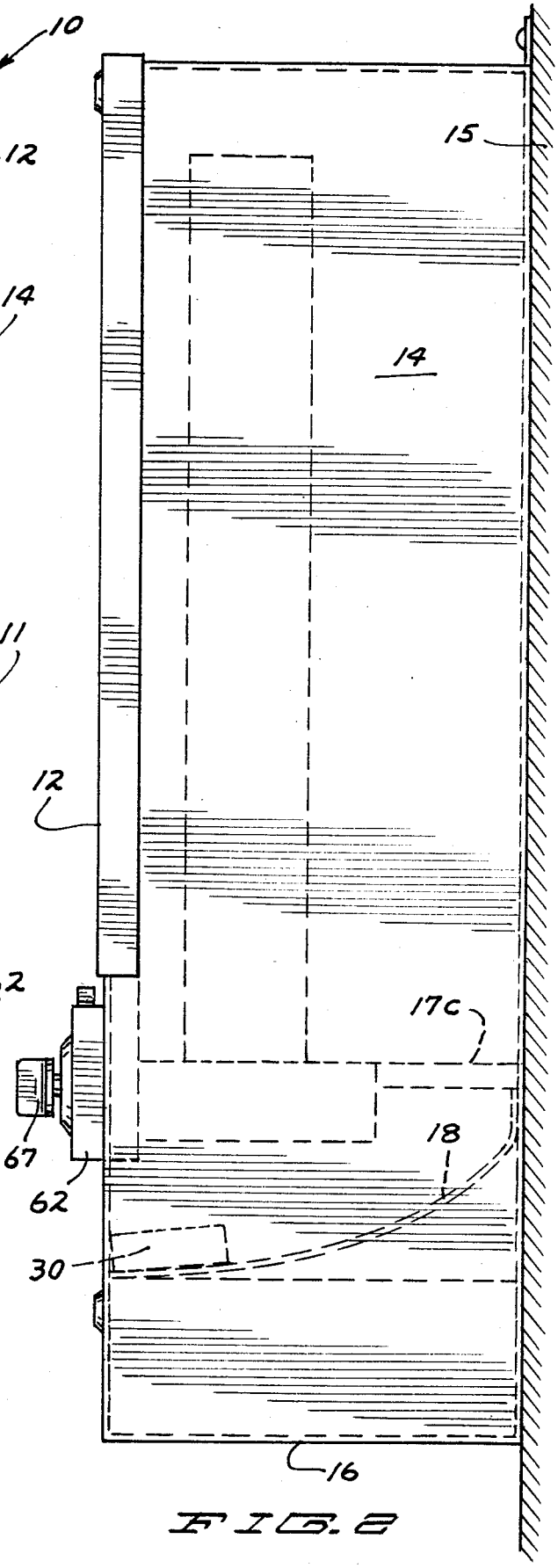
FIG. 2 is a view in side elevation.
Figure 4:
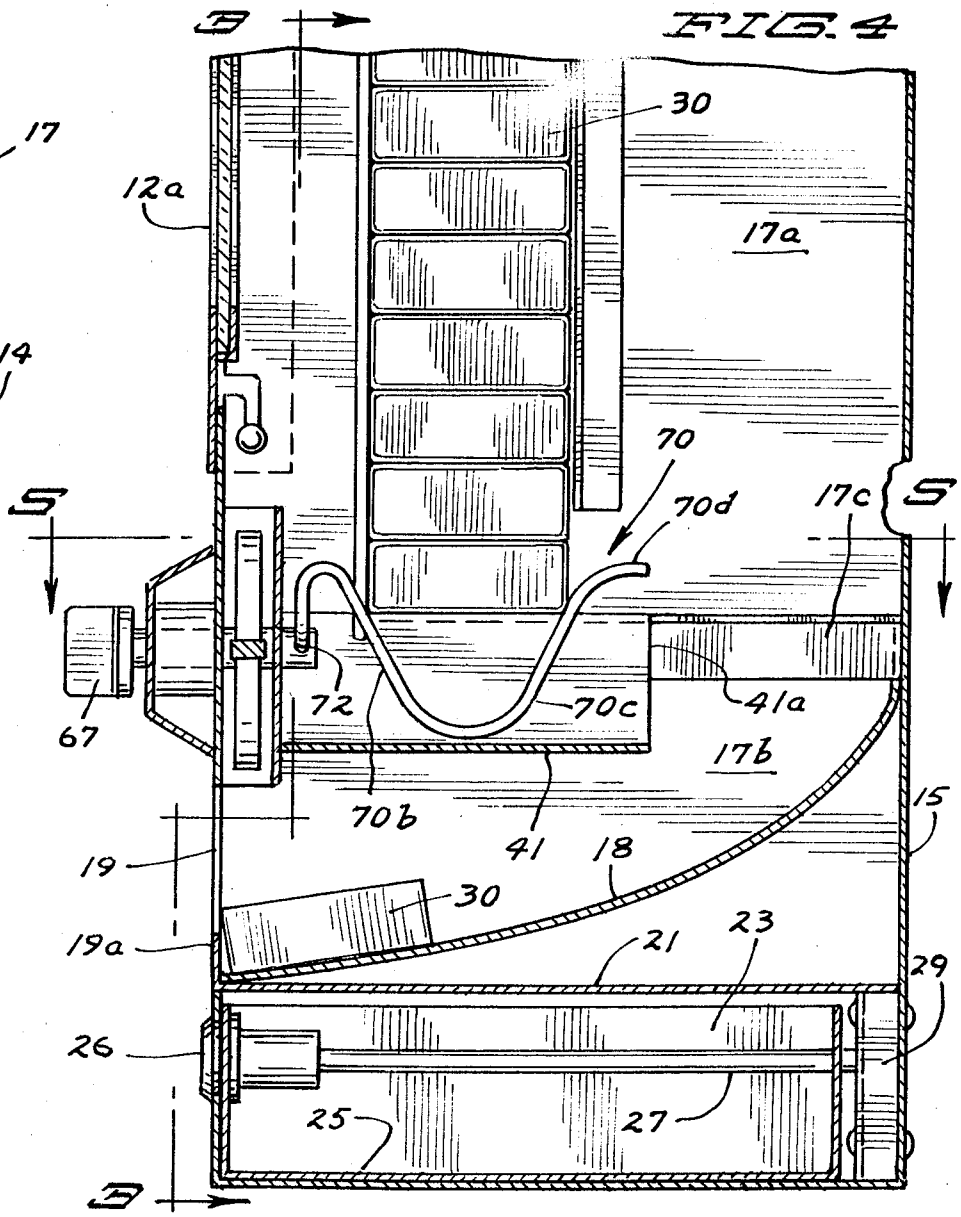
FIG. 4 is a broken view in vertical section taken on line 4—4 of FIG. 1 as indicated.
Figure 3:
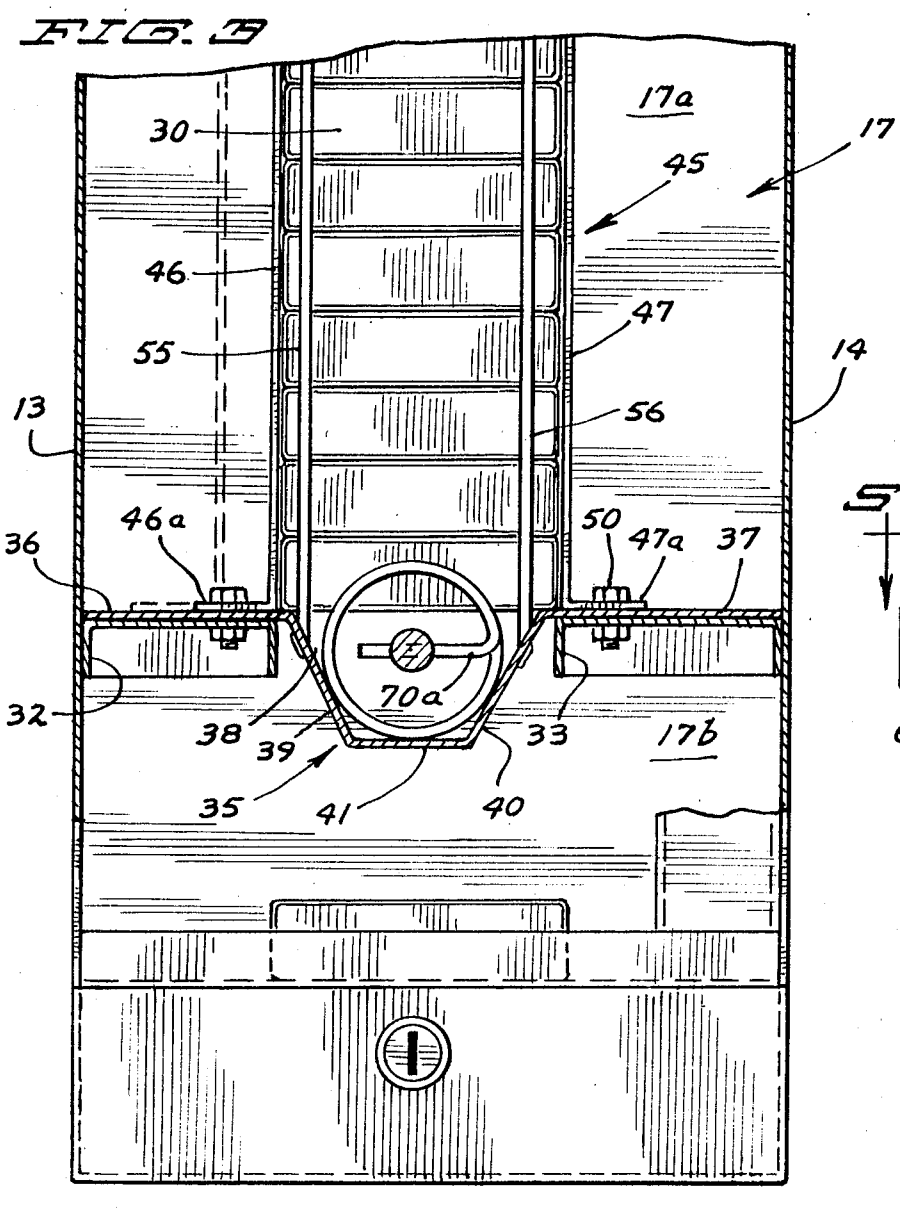
FIG. 3 is a broken view in vertical section taken on line 3—3 of FIG. 1 as indicated.

Referring to the drawings, a vending machine 10 is shown of a type being particularly adapted to dispense such articles as cigarettes, candy bars and other like sized packaged goods.

The vending machine, in being of a conventional design, will be described in such detail as to clearly define the modification thereof to embody therein the structure which comprises the invention herein.

Said vending machine as shown comprises a housing 11 having a front wall 12, side walls 13 and 14, a rear wall 15, and a bottom wall 16 and formed therein is a chamber 17. Said front wall is shown having a central vertical transparent insert 12*a*.

Said chamber comprises an upper chamber portion 17*a* into which is disposed a supply of a product 30, as will be described, and a lower chamber portion 17*b* which is the dispensing chamber having an inclined discharge ramp 18 therein discharging through an opening 19 in the front wall 12, said opening having a bottom upstanding ledge or stop member 19*a*.

Said dispensing chamber has a bottom wall 21 and formed between said bottom wall and the bottom wall 16 of said housing is a chamber 23 having a coin receptacle 25 therein formed as a pull out drawer and the same is secured by a conventional lock 26 having a latch bar 27 secured in a latch plate 29 secured to rear wall 15.

Dividing said chamber portions 17*a* and 17*b* are transversely spaced inverted channel members 32 and 33 extending from the front to the rear walls of said housing, the same being secured at their outer sides as by welding to the respective adjacent side walls 13 and 14 of said housing.

Overlying said channel members 32 and 33 with flange portions 36 and 37 and depending therebetween is a member 35 having a central trough portion 38 formed with inclined sides 39 and 40 and a bottom wall 41, the same being in the form of a truncated V in cross section. Said member 37 may be suitably secured as by welding.

Upstanding from said member 35 is a chute 45 extending substantially the height of the interior of said chamber 17*a* comprising a pair of transversely spaced side walls 46 and 47, said walls having outturned flanges 46*a* and 47*a* at their bottoms, the same being secured to said channel members 32 and 33 through the overlying flange portions 36 and 37 as by metal screws 50.

Figure 5:
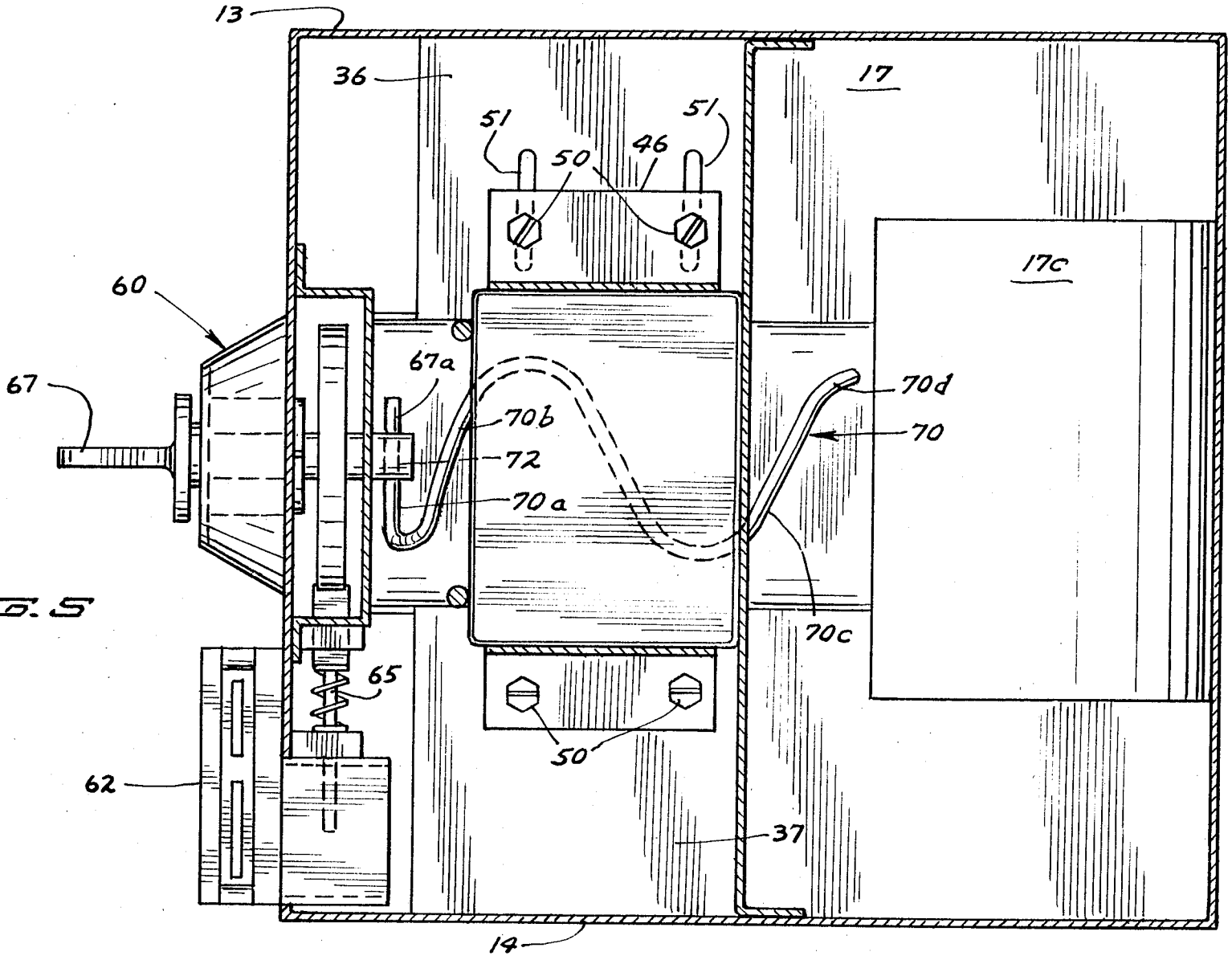
FIG. 5 is a view in horizontal section taken on line 5—5 of FIG. 5 as indicated.

Said overlying flange 36 and the underlying channel member 32 have elongated sides 51 therein as indicated in FIG. 5 for lateral adjustment of the wall 46.

Of narrower spacing than said walls 46 and 47 and somewhat forwardly thereof and upstanding from the side walls of said trough 38 are a pair of bars 55 and 56 which merely retain the product 30 within said chute 45.

The member 35 is in effect suspended within the chamber 17*b* and has its inner or rear end portion 41*a* terminating to be spaced inwardly of the back wall 15 to allow passage through the opening 17*c* to the discharge ramp 18 therebelow.

Carried in the front wall 12 adjacent the forward end of said trough 38 is a conventional type of a vending machine lock structure 60 having in connection therewith a slotted coin receptacle 62 which, upon the receipt of appropriate coins, will cause the release of the spring loaded latch bar 65 and permit the operating handle 67 to be rotated to dispense a unit of product, as will be described.

Disposed within said trough 38 is a coil dispensing member 70 having a length to extend just beyond the inner end of said trough and having a pitch such that a product 30 will seat within the coil (70*b*–70*c*) of said member and will advance along said member upon rotation of said member to be discharged therefrom. Said member 70 is here illustrated as being formed of a wire stock material.

Said member is shown consisting essentially of a complete central coil having sides 70*b* and 70*c* and a terminal end portion 70*d*, the forward end portion 70*a*, as described, being engaged by the inward operating handle extension or keeper 67*a*.

Said forward end portion 70*a* of said member 70 is bent to form a radial portion which is disposed through a hole 72 of said keeper 67*a*.

At the rear of said member 70 is an opening 17*c* formed between said members 32 and 33 beyond the end of said trough 41. Said opening leads directly to the chamber 17*b* and to the discharge ramp 18.

One rotation of the operator or handle 67 is sufficient to have a unit of product nested or seated within said coil of said member 70 to be advanced by rotation of said member to be discharged from the inward end portion 70*d* of said member.

Said trough 38 is merely illustrative of one form of structure to retain the member 70.

The essential novelty of the invention herein is present in the structure and orientation of said member 70. The member 70 upon its rotation advances rearwardly upon itself the product nested or seated upon its coil 70*b*–70*c*. Upon reaching the rearward end 70*d* of said member 70, the product drops off of said member and through the opening 17*c* down onto the discharge ramp 18 to be conveyed to the opening 19.

The use of the short horizontally disposed member 70 provides for the vertical stacking of goods instead of a horizontal front to rear placement of goods which requires considerable depth of floor space. Applicant's structure permits a vending housing to be designed to occupy limited floor space with emphasis on height for very significant convenience in placement.

It will of course be understood that various changes may be made in the form, details, arrangement and proportions of the product without departing from the scope of applicant's invention which, generally stated, consists in a product capable of carrying out the objects above set forth, such as disclosed and defined in the appended claims.

What is claimed is:

1. A vending machine product dispensing mechanism, having in combination a housing having an upper chamber having a vertically stacked supply of product therein and a lower chamber for dispensing said product, supporting means separating said chambers, means having non-linear horizontal movement supporting said stack of product, the lowermost unit of said stack of product being seated upon said last mentioned means, a trough retained by said supporting means, said second mentioned means comprises a coil member disposed in said trough, operating means external of said housing having an inward extension operatively engaging said coil member, said coil member being arranged and constructed that upon rotation the unit of product seated thereupon is caused to advance thereon to become discharged therefrom, and means in said lower chamber dispensing said unit of product discharged by said coil member.

2. A product dispensing mechanism in connection with a vending machine having a vertical stack of units of product therein, having in combination a housing having an upper supply receiving chamber and a lower product dispensing chamber, a coil member supporting said vertical stack of said product, a trough within said housing supporting said coil member, said coil member having the lowermost unit of said stack of product seated thereon and being arranged and constructed to have non-linear axial movement to advance said unit of product thereon and discharge the same therefrom, and operating means external of said housing having an inward extension thereof operatively engaging said coil member to rotate the same.

3. A product dispensing mechanism in connection with a vending machine having a vertical stack of units or product therein, having in combination a housing having an upper supply receiving chamber and a lower product dispensing chamber, a coil member supporting said vertical stack of said product, a trough within said housing supporting said coil member, said coil member having the lowermost unit of said stack of product seated thereon and being arranged and constructed to have non-linear axial movement to advance said unit of product thereon and discharge the same therefrom, operating means external of said housing having an inward extending shaft, said inward extending shaft having a hole therethrough, and an end portion of said coil member being disposed through said hole to be rotated thereby.

* * * * *